US005338436A

United States Patent [19]

Harandi

[11] Patent Number: 5,338,436

[45] Date of Patent: Aug. 16, 1994

[54] DEWAXING PROCESS

[75] Inventor: Mohsen N. Harandi, Lawrenceville, N.J.

[73] Assignee: Mobil Oil Corp., Fairfax, Va.

[21] Appl. No.: 73,267

[22] Filed: Jun. 8, 1993

Related U.S. Application Data

[63] Continuation of Ser. No. 779,658, Oct. 21, 1991, abandoned.

[51] Int. Cl.[5] ..... C10G 63/06; C10G 69/14; C10G 69/02; C10G 57/02

[52] U.S. Cl. ..... 208/80; 208/49; 208/60; 208/67; 208/70; 208/71; 208/100

[58] Field of Search ..... 208/49, 60, 71, 80, 208/100, 67, 70

[56] References Cited

U.S. PATENT DOCUMENTS 4,181,598 1/1980 Gillespie et al. ..... 208/86
4,361,477 11/1982 Miller ..... 208/67
4,437,976 3/1984 Oleck et al. ..... 208/49
4,648,957 3/1987 Graziani et al. ..... 208/58
4,695,364 9/1987 Graziani et al. ..... 208/59
4,746,762 5/1988 Avidan et al. ..... 585/415
4,981,574 1/1991 Harandi et al. ..... 208/60
4,990,712 2/1991 Harandi et al. ..... 585/324
5,013,329 5/1991 Bell et al. ..... 44/448
5,015,359 5/1991 Harandi et al. ..... 208/58

*Primary Examiner*—Paul Lieberman
*Assistant Examiner*—Patricia L. Hailey
*Attorney, Agent, or Firm*—Alexander J. McKillop; Dennis P. Santini; Edward F. Kenehan, Jr.

[57] ABSTRACT

There is provided a process for dewaxing a hydrocarbon feedstock, wherein the effluent from a dewaxing reaction zone is passed over an oligomerization catalyst under conditions sufficient to oligomerize olefins in this effluent. The temperature of the oligomerization reaction is less than the temperature of the dewaxing reaction.

20 Claims, 3 Drawing Sheets

DEWAXING PROCESS

This is a continuation of copending application Ser. No. 07/779,658, filed on Oct. 21, 1991, now abandoned.

BACKGROUND

There is provided a process for dewaxing a hydrocarbon feedstock, wherein the effluent from a dewaxing reaction zone is passed over an oligomerization catalyst under conditions sufficient to oligomerize olefins in this effluent. The temperature of the oligomerization reaction is less than the temperature of the dewaxing reaction.

Catalytic dewaxing of hydrocarbon oils to reduce the temperature at which precipitation of waxy hydrocarbons occurs is known process and is described, for example, in the *Oil and Gas Journal,* Jan. 6, 1975, pages 69–73. A number of patents have also described catalytic dewaxing processes. U.S. Pat. No. Reissue 28,398 describes a process for catalytic dewaxing with a catalyst comprising a medium-pore zeolite and a hydrogenation/dehydrogenation component. U.S. Pat. No. 3,956,102 teaches a process for hydrodewaxing a gas oil with a medium-pore zeolite catalyst. U.S. Pat. No. 4,100,056 discloses a Mordenite catalyst containing a Group VI or a Group VIII metal which may be used to dewax a distillate derived from a waxy crude. U.S. Pat. No. 3,755,138 describes a process for mild solvent dewaxing to remove high quality wax from a lube stock, which is then catalytically dewaxed to specification pour point. Such developments in catalytic dewaxing have led to the MLDW (Mobil Lube Dewaxing) and MDDW (Mobil Distillate Dewaxing) processes. The entire contents of the above-listed publications and patents are incorporated by reference as if set forth at length herein.

Dewaxing is typically a two-step process comprising catalytic dewaxing followed by hydrotreating. Certain feedstocks, particularly distillate feedstocks, however, may meet product specifications without hydrotreating. In lubricant manufacturing, hydrotreating improves color and stability of the finished product. Hydrotreating saturates the olefinic by-products from the dewaxing reaction and is typically used for this purpose as well as to reduce sulfur and to increase octane number in distillate products. For example, U.S. Pat. No. 3,668,113 describes a catalytic dewaxing process employing a Mordenite dewaxing catalyst which is followed by a catalytic hydrodesulfurization step over an alumina-based catalyst. U.S. Pat. No. 4,400,265 describes a catalytic dewaxing/hydrodewaxing process using a zeolite catalyst having the structure of ZSM-5 wherein gas oil is catalytically dewaxed followed by hydrodesulfurization in a cascade system. Hydrotreating processes are widely used in the petroleum refining industry and are exemplified by the processes described in Milstein et al. U.S. Pat. No. 4,054,508; Jaffe U.S. Pat. No. 4,267,071; and Angevine et al. U.S. Pat. No. 4,600,503, each of which is incorporated by reference as if set forth at length herein.

U.S. Pat. No. 5,015,359 teaches a hydrodewaxing process with interstage recovery of olefinic gasoline and is incorporated by reference as if set forth at length herein. The hydrodewaxing process described comprises a first catalytic dewaxing reaction zone containing a medium-pore zeolite catalyst and a second hydrotreating reaction zone. By separating the olefinic naphtha prior to the hydrotreating step, hydrogen consumption is reduced and a smaller hydrotreating reactor may be used.

By-products of these catalytic dewaxing processes include highly olefinic gasoline having a research clear octane number in the range of 80 to 95. Motor octane numbers for this olefinic gasoline stream typically range from about 65 to 80. Road octane numbers for finished gasoline product are calculated as the arithmetic mean of the research and motor octane numbers. At the present time, road octane numbers for gasoline sold at retail equal or exceed 87 and generally range between 87 and 93. Low octane olefinic gasoline is therefore typically undesirable for use as a gasoline blending component. Further, the olefin contents of more than 20 wt. % preclude economic upgrading of this stream via catalytic reforming.

Catalytic reforming is widely used to increase octane in gasoline boiling range feedstocks. Paraffinic feedstocks are more easily upgraded in a catalytic reformer than olefinic feedstocks. Olefinic feedstocks tend to form excessive amounts of coke in the reformer reactors and cause more rapid deactivation of the reforming catalyst. Consequently, reformers are typically equipped with pretreaters which catalytically react naphtha feedstock with hydrogen to saturate olefins and to remove sulfur compounds which poison the reforming catalyst. Hydrogen consumption is related to the concentration of olefinic compounds in pretreater feed and, as a result, olefinic feeds consume significantly more hydrogen during pretreatment than paraffinic feeds, making olefinic feeds more costly to pretreat.

The economic benefit of the catalytic reforming octane boost is offset by liquid product yield loss. This loss becomes more pronounced as reaction severity increases until the economic octane boost. For a general discussion of naphtha reforming, see 17 *Kirk Othmer Encyclopedia of Chemical Technology,* 218–220, 3rd edition, 1982.

Thus, the gasoline stream produced in a catalytic dewaxing unit is relatively difficult and expensive to upgrade in a catalytic reforming process. Further, the catalytic reforming process units are typically sized to accommodate the available paraffinic naphtha feed, and lack capacity to process a supplemental olefinic feedstock.

Olefinic gasoline streams may be readily upgraded to high octane gasoline via catalytic aromatization as disclosed in Cattanach U.S. Pat. No. 3,756,942 and Brennan et al. U.S. Pat. No. 3,759,821, the disclosures of which are incorporated by reference as if set forth at length herein.

Certain olefins may be converted to heavier hydrocarbons, such as $C_5+$ gasoline, distillates or lubes. Examples of such conversions are embodied in Mobil olefins to gasoline (MOG), Mobil olefins to gasoline/distillate (MOGD) and Mobil olefins to gasoline/distillate/-lubes (MOGDL).

In MOGD and MOGDL, olefins are catalytically converted to heavier hydrocarbons by catalytic oligomerization using an acid crystalline zeolite, such as a ZSM-5 catalyst. Process conditions can be varied to favor the formation of either gasoline, distillate or lube range products. Plank et al. U.S. Pat. Nos. 3,960,978 and 4,021,502 disclose the conversion of $C_2$–$C_5$ olefins, alone or in combination with paraffinic components, into higher hydrocarbons over a crystalline zeolite catalyst. Garwood et al. U.S. Pat. Nos. 4,150,062; 4,211,640;

and 4,227,992 have contributed improved processing techniques to the MOGD system. Marsh et al. U.S. Pat. No. 4,456,781 has also disclosed improved processing techniques for the MOGD system. Tabek U.S. Pat. No. 4,433,185 teaches conversion of olefins in a two-stage system over a ZSM-5 and ZSM-11 zeolite catalyst to form gasoline or distillate.

Olefinic feedstocks may be obtained from various sources, including from fossil fuel processing streams, such as gas separation units, from the cracking of $C_2$+ hydrocarbons, such as LPG (liquified petroleum gas), from coal by-products and from various synthetic fuel processing streams. Chen et al. U.S. Pat. No. 4,100,218 teaches thermal cracking of ethane to ethylene, with subsequent conversion of ethylene to LPG and gasoline over a ZSM-5 zeolite catalyst.

The conversion of olefins in a MOGDL system may occur in a gasoline mode and/or a distillate/lube mode. In the gasoline mode, the olefins are catalytically oligomerized at temperatures ranging from 400° to 800° F. and pressures ranging from 10 to 1000 psia. To avoid excessive temperatures in an exothermic reactor, the olefinic feed may be diluted. In the gasoline mode, the diluent may comprise light hydrocarbons, such as $C_3$–$C_4$, from the feedstock and/or recycled from debutanized oligomerized product. In the distillate/lube mode, olefins are catalytically oligomerized to distillate at temperatures ranging from 350° to 600° F. and pressures ranging from 100 to 3000 psig. The distillate is then upgraded by hydrotreating and separating the hydrotreated distillate to recover lubes.

MOG is described in greater detail in Bell et al U.S. Pat. No. 5,013,329 and in Avidan et al. U.S. Pat. No. 4,746,762.

SUMMARY

There is provided a process for dewaxing a hydrocarbon feedstock comprising the steps of:

(a) contacting said feedstock with a dewaxing catalyst under conditions sufficient to crack wax molecules and produce olefins having 10 or less carbon atoms; and (b) contacting either (i) the entire effluent from step (a) or (ii) a cut of the effluent of step (a) with an oligomerization catalyst under conditions sufficient to oligomerize olefins therein, wherein the temperature of the oligomerization reaction of step (b) is at least 5° C. less than the temperature of the dewaxing reaction of step (a).

EMBODIMENTS

Figure 1:
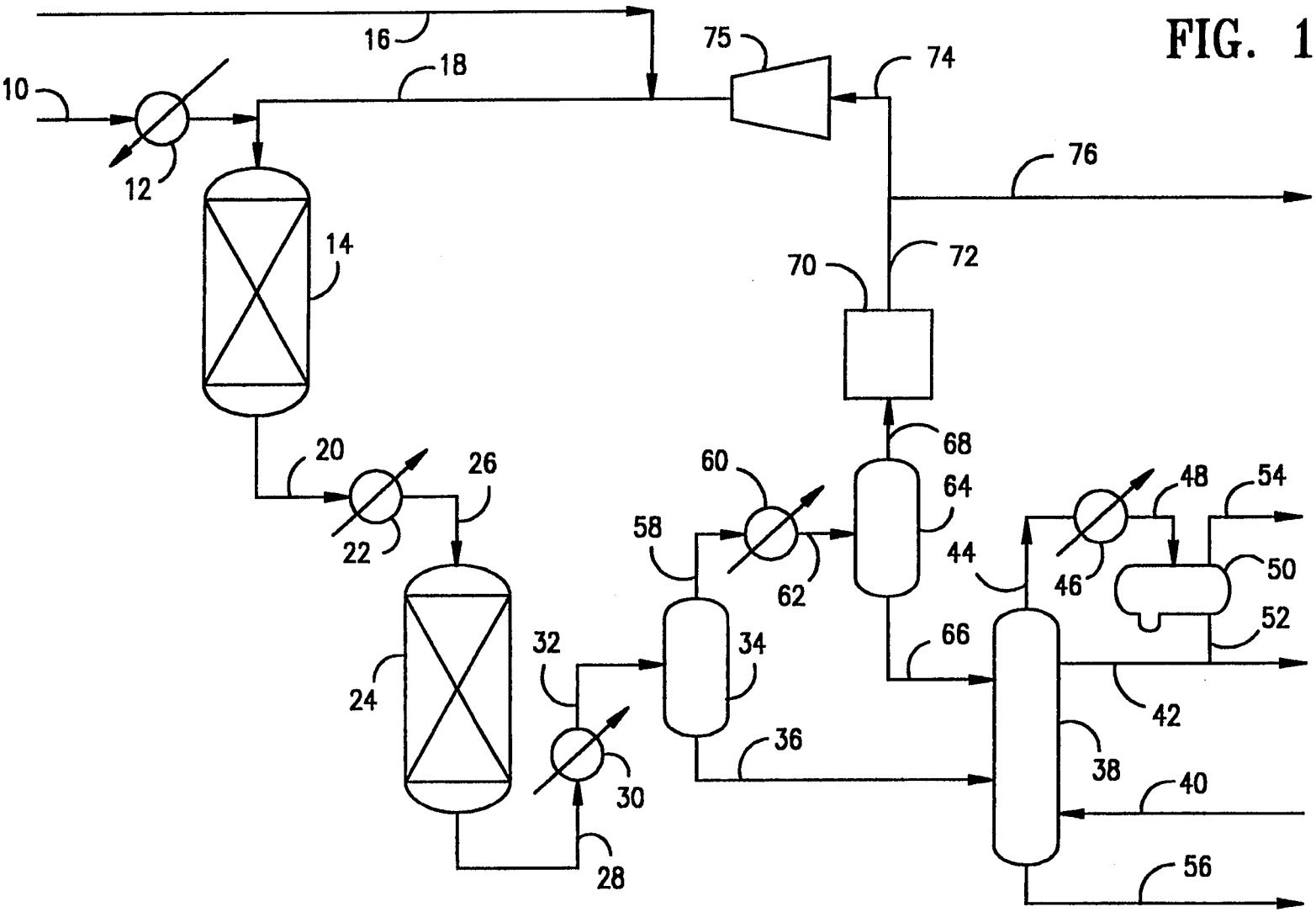
FIG. 1 is a schematic representation of a hydrodewaxing process using two reactors for hydrodewaxing, oligomerization and hydrotreating.

During the operation of a catalytic dewaxing process, the catalyst accumulates coke and/or catalyst poisons which progressively block access to active sites in the catalyst pores. This accumulation reduces catalytic activity. To compensate for this loss of catalytic activity, reaction temperature is increased.

The feedstocks useful for producing lubricant and distillate products in the present invention are easily cracked. Examples of such feedstocks include lubricant boiling range feeds and distillate feeds. Particular examples of such feeds include atmospheric gas oil and vacuum gas oil. Cracking at least partially converts the highly valuable lubricant and distillate stocks into less valuable light $C_3$- aliphatic gas and coke which is deposited on the catalyst. Thus, cracking rapidly ages the catalyst and markedly decreases the value of the charge stream. From a practical point of view, therefore, catalytic dewaxing temperature is limited by the cracking temperature of the feedstock. Dewaxing catalyst is considered to be deactivated when the activity level has decreased to the point that reaction temperatures mild enough to avoid excessive cracking are insufficient to dewax the feedstock to the desired pour point.

Catalytic dewaxing conditions include a temperature between about 475° F. (246° C.) and 850° F. (454° C.), and a pressure between about 100 and about 3000 psig. The liquid hourly space velocity is generally between about 0.1 and about 10 and the hydrogen to feedstock ratio is generally between about 0 and about 8000 SCF/BBL feed. Broad and preferred ranges of process conditions for dewaxing both distillate and lubricant stocks are summarized in Table 1.

The catalytic dewaxing process of this invention may be conducted by contacting the feed to be dewaxed with a stationary bed of defined crystalline aluminosilicate zeolite catalysts, or with a transport bed, as desired. A simple and therefore preferred configuration is a trickle-bed operation in which the feed is allowed to trickle through a stationary fixed bed, preferrably in the presence of hydrogen. The most preferred reactor configuration is a fixed-bed radial flow reactor. With such configuration, it is of considerable importance in order to obtain the benefits of this invention to initiate the dewaxing reaction with fresh catalyst at a temperature of about 475° to 550° F., depending on the required product quality. This temperature is, of course, raised as the catalyst ages, in order to maintain the desired reaction rate. The run is terminated when the reactor reaches the end-of-run temperature which is typically just below the temperature at which feedstock cracking becomes excessive. Degradation in product quality accompanied by an increase in light $C_4$- gas production signals excessive feedstock cracking. This rapidly ages the catalyst by blocking the active sites with a relatively heavy layer of coke. Excessive cracking of the feedstock is therefore highly undesirable and must be minimized for economic unit operation. In the present process, feedstock charge is discontinued when the reaction temperature nears a level which would promote excessive cracking. For distillate dewaxing, the maximum feedstock charge temperature is typically about 427° C. (800° F.) and for lubricant dewaxing the maximum charge temperature is typically about 357° C. (675° F.)

When the catalytic dewaxing reaction temperature approaches the end-of-run temperature as described above, the flow of feedstock to the reaction zone is shut off. Hydrogen-rich gas may be circulated through the process furnace and the reaction zone. During this step, the catalyst typically regains a portion of its original catalyst activity. The circulation gas may alternatively comprise an oxygen-containing gas to affect at least a partial oxidative reactivation.

During the time which hydrogen-rich or oxygen-containing gas is circulating through the process furnace and the reaction zone, the dewaxing feedstock is preferably drained from the process equipment. If the dewaxing feedstock cannot be drained in the time allotted for the gas circulation step, the dewaxing feedstock may be separated from the upgraded gasoline product in a downstream product separation facility.

TABLE 1

| | Dewaxing Process Conditions | |
|---|---|---|
| | Lubricant Dewaxing | Distillate Dewaxing |
| LHSV ($hr^{-1}$) | 0.1–10 | 0.1–10 |
| Reactor Operating Temperature °C. (°F.) | 246°–357° C. (475°–675° F.) | 260°–454° C. (500°–850° F.) |
| Operating Pressure kPa (psig) | 790–20,790 kPa (100–3000 psig) | 790–20,790 kPa (100–3000 psig) |
| Hydrogen Dosage SCF/BBL feed | 0–8000 | 0–8000 |

In the process described herein, hydrocarbons are subjected to the following three reactions: hydrodewaxing, oligomerization and hydrotreating. Each of these reactions takes place in the presence of a catalyst.

The hydrodewaxing catalyst possesses both shape-selective paraffin cracking activity and hydrogenation activity. Catalysts that have shape-selective qualities include crystalline zeolite catalysts and crystalline silica alumina phosphate (SAPO) catalysts. These materials may be unbound or bound in a variety of matrices, such as those containing silica and alumina or silica or alumina alone. The catalysts may contain up to 15% metals that are known to possess a hydrogenation ability. Hydrogenation components include the noble metals of Group VIII, especially platinum and palladium, but other noble metals, such as iridium, ruthenium or rhodium, may also be used. Combinations of noble metals with non-noble metals, such as nickel, rhenium, tungsten, chromium and molybdenum may be used. Combinations of Group VIB and Group VIII may also be used. Base metal hydrogenation components may also be used, especially nickel, cobalt, molybdenum, tungsten, copper or zinc.

The metal may be incorporated into the catalyst by any suitable method such as impregnation or exchange onto the zeolite. The metal may be incorporated in the form of a cationic, anionic or a neutral complex, such as $Pt(NH_3)_4^{2+}$, and cationic complexes of this type, will be found convenient for exchanging metals onto a zeolite. Anionic complexes are also useful for impregnating metals into the zeolites.

The medium-pore zeolite catalysts useful in the present invention have an effective pore size of generally from about 5 to about 8 Angstroms, such as to freely sorb normal hexane. In addition, the structure must provide constrained access to larger molecules. It is sometimes possible to judge from a known crystal structure whether such constrained access exits. For example, if the only pore windows in a crystal are formed by 8-membered rings of silicon and aluminum atoms, then access by molecules of larger cross-section than normal hexane is excluded and the zeolite is not of the desired type. Windows of 10-membered rings are preferred, although, in some instances, excessive puckering of the rings or pore blockage may render these zeolites ineffective.

Although 12-membered rings in theory would not offer sufficient constraint to produce advantageous conversions, it is noted that the puckered 12-ring structure of TMA offretite does show some constrained access. Other 12-ring structures may exist which may be operative for other reasons, and therefore, it is not the present intention to entirely judge the usefulness of the particular zeolite solely from theoretical structural considerations.

A convenient measure of the extent to which a zeolite provides control to molecules of varying sizes to its internal structure is the Constraint Index of the zeolite. The method by which the Constraint Index is determined is described in U.S. Pat. No. 4,016,218, incorporated herein by reference for details of the method. U.S. Pat. No. 4,696,732 discloses Constraint Index values for typical zeolite materials and is incorporated by reference as if set forth at length herein.

The medium-pore catalysts particularly useful in the present invention include zeolite catalysts having the structure of ZSM-5, ZSM-11, ZSM-12, ZSM-22, ZSM-23, ZSM-35, ZSM-48 and other similar materials. U.S. Pat. No. 3,702,886 describing and claiming ZSM-5 is incorporated herein by reference. Also, U.S. Pat. No. Re. 29,948 describing and claiming a crystalline material with an X-ray diffraction pattern of ZSM-5 is incorporated herein by reference.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

ZSM-23 is more particularly described in U.S. Pat. No. 4,076,842, the entire contents of which are incorporated herein by reference.

ZSM-35 is more particularly described in U.S. Pat. No. 4,016,245, the entire contents of which are incorporated herein by reference.

ZSM-48 is more particularly described in U.S. Pat. No. 4,375,573, the entire contents of which are incorporated herein by reference.

The zeolites suitable for use in the present invention can be modified in activity by dilution with a matrix component of significant or little catalytic activity.

Catalysts including zeolites such as ZSM-5 combined with a Group VIII metal described in U.S. Pat. No. 3,856,872, incorporated by reference as if set forth at length herein, are also useful in the present invention. Nickel-containing ZSM-5 is particularly preferred for the dewaxing process of the present invention.

The oligomerization catalyst may comprise a medium-pore size zeolite. This medium-pore size zeolite may be the same or different from the medium-pore size zeolite used in the hydrodewaxing catalyst. The oligomerization catalyst may optionally comprise a hydrogenation metal. The oligomerization catalyst may be the same as or different from the hydrodewaxing catalyst. However, it will be noted that, even when the oligomerization catalyst is the same as the hydrodewaxing catalyst, the oligomerization catalyst will promote little or no dewaxing, because readily removable wax molecules have already been removed by the hydrodewaxing process and the oligomerization reaction takes place at a lower temperature than the hydrodewaxing reaction. The oligomerization reaction conditions may fall within the range given in Table 1, provided that a lower temperature is used in the oligomerization reaction than in the dewaxing reaction.

The hydrotreating catalyst may comprise a hydrogenation metal on a non-acidic oxide support. This support may be an amorphous material, such as alumina. A zeolite need not be included in the hydrotreating catalyst. Particular hydrotreating catalysts include cobalt-molybdenum- or nickel-tungsten-containing catalysts.

Hydrotreating may take place at a temperature of about 500° C. to about 700° F. (260°–371° C.), a pressure of about 100 to about 500 psig (8–36 bars), a space velocity of about 0.5 to about 5.0 LHSV (liquid hourly space velocity), and a hydrogen feed rate of about 1000 to about 5000 SCF/bbl. Hydrotreating generally does not affect pour point of the product.

The feed for the oligomerization reaction preferably comprises the entire effluent of the hydrodewaxing reaction. However, a cut from the hydrodewaxing effluent may also be used as the feed for the oligomerization reaction. This cut may be achieved by channelling a side stream from the remainder of the effluent. Since a hydrocarbon separation step, such as stripping with a stripping medium, is not used in obtaining this cut, the cut will have essentially the same olefin concentration, e.g. in terms of weight percent of olefins, as the entire effluent from the hydrodewaxing reaction. In addition to effluent from the hydrodewaxing reaction, the feed for the oligomerization reaction may optionally comprise at least one additional source of olefins, e.g. from recycle streams or from external sources. When a cut from the effluent of the dewaxing reaction is used as the feed for the oligomerization reaction, this cut may comprise at least 10 weight percent of the entire effluent from the dewaxing reaction.

Since paraffins and, usually, aromatics are present in the feed for the oligomerization reaction, a certain portion of olefins in this feed may be converted by an alkylation reaction, whereby aromatics and/or paraffins are alkylated. Olefin oligomer products may also be converted by such alkylation reactons. It will be understood that alkylation of paraffins may require relatively severe reaction conditions, including high pressure. Alkylation of aromatics generally requires less severe reaction conditions.

In accordance with the present process, a typical yield of $C_4$- hydrocarbons from MDDW can be reduced by about 30%. In addition, other refinery streams such as FCC LPG can be upgraded to C5+ product in the dewaxing process. The new process design upgrades the dewaxing reactor effluent in an olefin upgrading reactor. This olefin upgrading reactor may operate under conditions used for MOG, MOGD or MOGDL. The olefin upgrading reactor may operate at about 10°–350° F. (5°–195° C.) lower than the dewaxing reactor which preferably operates at 400°–600° F. (204°–316° C.). The last stage of a multi-bed dewaxing reactor can also be modified to operate as an olefin upgrading reactor. The lower operating temperature promotes oligomerization and alkylation of light olefins and prevents significant dewaxing of the dewaxed effluent. The olefinic naphtha by-product can be separated and recycled back to the reaction section if it is desired to produce more jet fuel or heavier product.

In accordance with one alternative embodiment of the present invention, oligomerization catalyst may be placed in the top section of a hydrotreating reactor. In this embodiment, the hydrotreating and oligomerization reactions are performed in the same reactor under essentially the same operating conditions, thereby obviating the need for separate apparatus for oligomerization and hydrotreating reactions.

FIG. 1 shows a schematic of a lube hydrodewaxing process in which a hydrocarbon fraction such as a lube range raffinate feed is fed via conduit 10 through heat exchanger 12 to a hydrodewaxing reactor 14. A source of hydrogen (not shown) is fed through conduit 16 to hydrodewaxing reactor 14 with make-up hydrogen supplied through line 18. Conventional temperatures for the mixture of lube raffinate feed and hydrogen gas fed to the hydrodewaxing reactor 14 typically vary between about 550° and about 675° F. during the course of the dewaxing cycle, at about 527–557 psig. The dewaxed reactor effluent exiting through conduit 20 may be at a temperature of about 550°–675° F. and a pressure of about 516–531 psig. This effluent passes through heat exchanger 22 and conduit 26 into hydrotreating reactor 24, typically at a temperature of about 500° F. The hydrotreater reactor effluent leaving hydrotreating reactor 24 through conduit 28 is typically at a temperature about 515° F. as it passes through heat exchanger 30 and conduit 32 as it is fed to separator 34. The bottoms from separator 34 are fed by conduit 36 to naphtha stripper 38. Separator 34 is normally maintained at a pressure less than that of hydrotreater 24, typically about 485 psig. Naphtha stripper 38 operates in a conventional manner with steam introduced through conduit 40 into the lower portion of naphtha stripper 38 to separate naphtha and light gases from the lube oil and kerosene leaving naphtha stripper 38 as the bottoms fraction through conduit 56. After passing the stripper overhead in conduit 44 through heat exchanger 46 and conduit 48 to settling tank 50, unstabilized naphtha is withdrawn through conduit 52 while lighter gases are withdrawn through conduit 54 for use as fuel or feed to an MOGDL unit. The bottoms effluent from stripper 38 comprising lube oil and kerosene are conveyed in conduit 56, to downstream processing units, such as a vacuum The lighter effluent leaving separator 34 through conduit 58 passes through heat exchanger 60 and conduit 62 to separator 64. The bottoms from separator 64 are fed through conduit 66 to an intermediate level in the naphtha stripper 38. Contaminants such as hydrogen sulfide ($H_2S$) plus nitrogen are removed from the effluent leaving separator 64 through conduit 68 in scrubber 70. The hydrogen leaving scrubber 70 via line 72 is partly recycled through conduit 74 and recycle compressor 75 to hydrodewaxing reactor 14 and partly removed through conduit 76.

In FIG. 1 the hydrodewaxing reactor 14 and/or the hydrotreating reactor 24 are multiple stage reactors. The individual stages of these reactors are not shown in FIG. 1. The stages of these reactors may comprise separate catalyst compartments each equipped with means for controlling the reaction temperature therein. When a hydrodewaxing reaction is conducted in a multiple stage reactor, it is customary to use increasing reaction temperatures in successive stages. In this way, more readily removable wax molecules are first removed at lower temperatures in the first stages without aging the catalyst in these first stages more rapidly than the catalyst in the latter stages.

In accordance with embodiments of the present invention, oligomerization catalyst may be placed in the bottom section of hydrodewaxing reactor 14 and/or the top section of hydrotreating reactor 24 and these sections may be operated under oligomerization conditions including a temperature which is at least 5° C. less than the temperature of the final dewaxing stage of the hydrodewaxing reactor 14.

Figure 2:
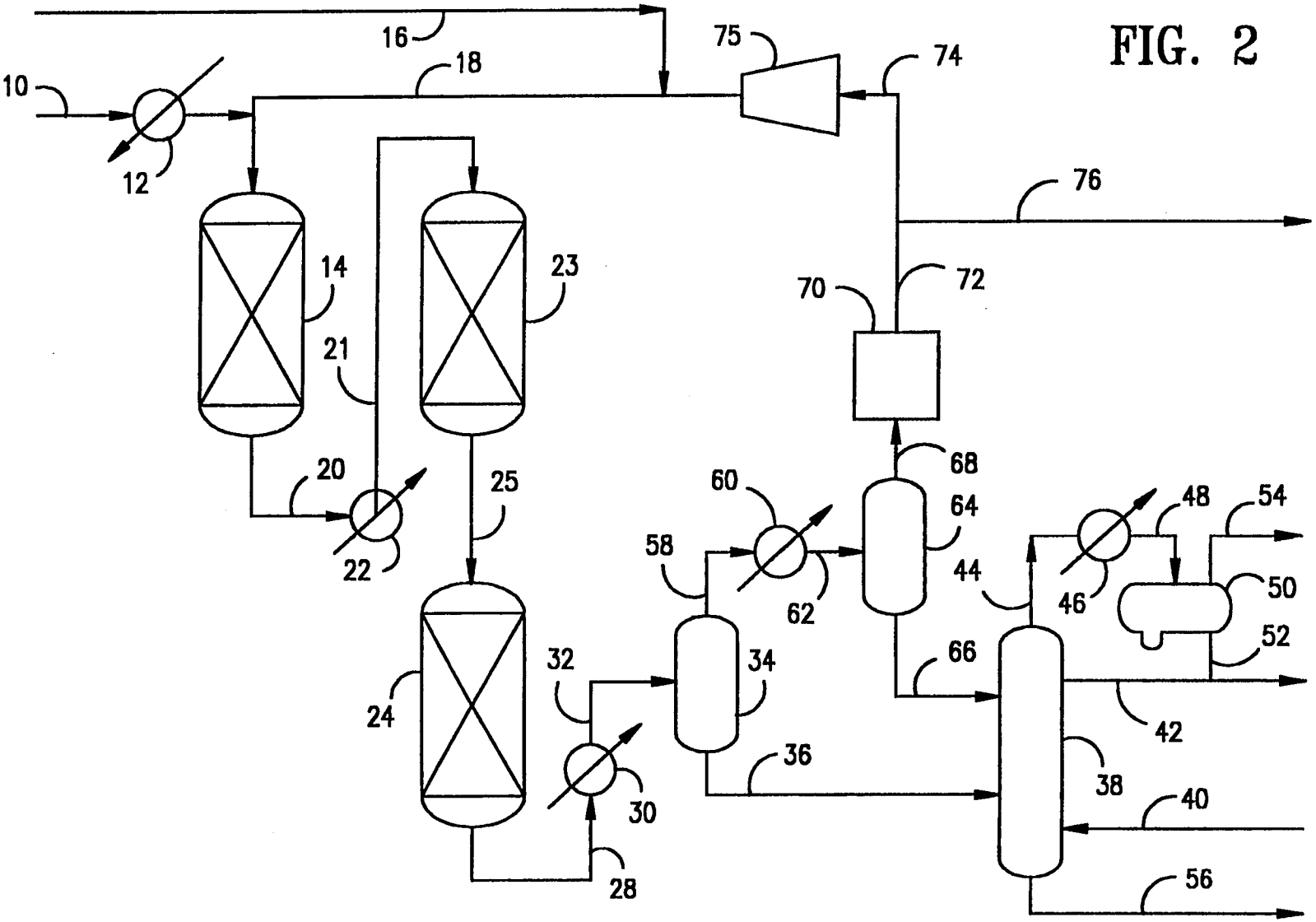
FIG. 2 is a schematic representation of a hydrodewaxing process using three reactors for hydrodewaxing, oligomerization and hydrotreating.

FIG. 2 illustrates an alternative embodiment of the present invention, wherein three separate reactors for hydrodewaxing, oligomerization and hydrotreating are used. The numbered pieces of apparatus in FIG. 2 correspond to those of FIG. 1, except that line 26 of FIG. 1 has been replaced by line 21, oligomerization reactor 23 and line 25 in FIG. 2. More particularly, in FIG. 2 effluent from heat exchanger 22 is passed via line 21 to oligomerization reactor 23 and effluent from oligomerization reactor 23 is passed via line 25 to hydrotreator 24.

Figure 3:
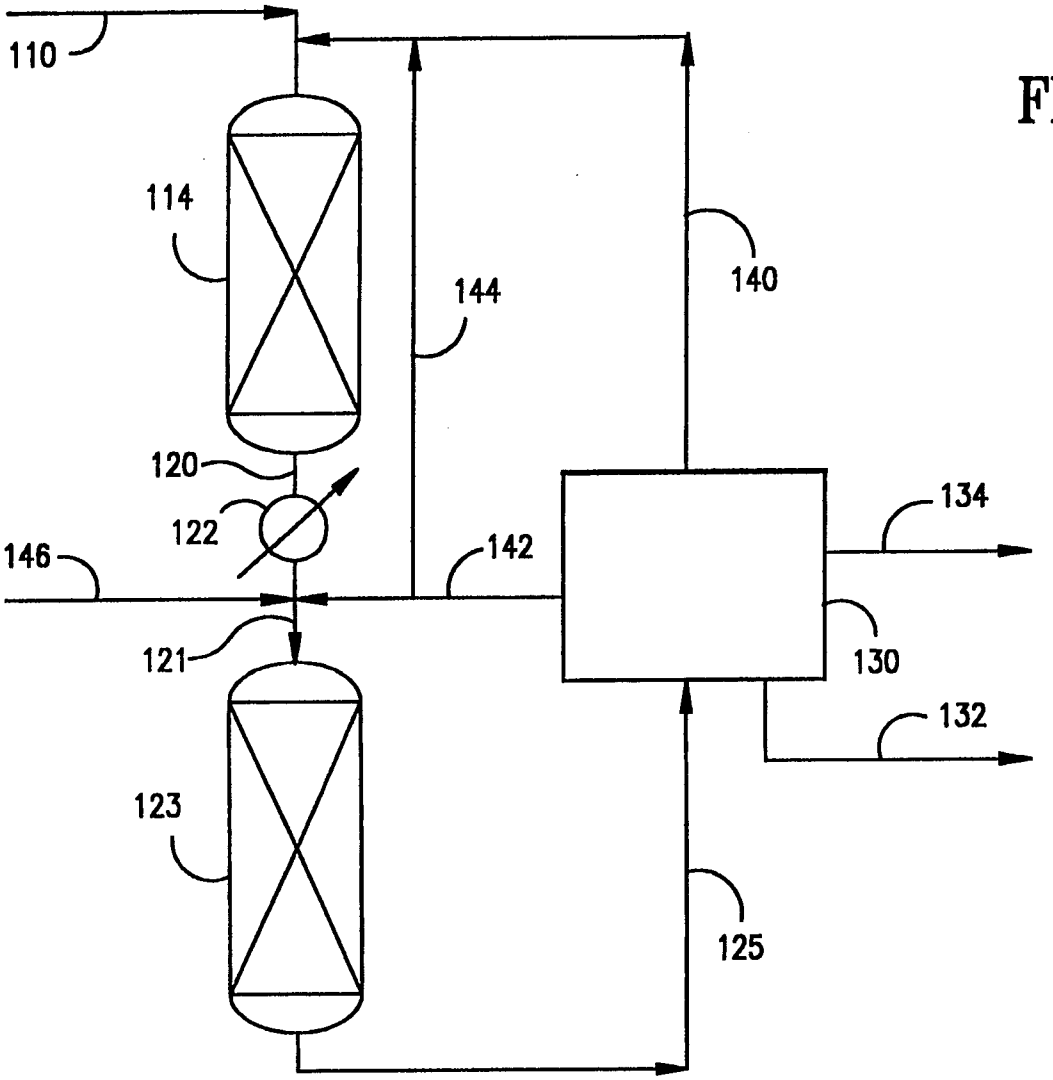
FIG. 3 is a schematic representation of a hydrodewaxing process, wherein optional olefin recycle streams are fed to the dewaxing reactor and/or to the oligomerization reactor, and wherein an optional additional olefins stream from an external source is fed to the oligomerization reactor.

In FIG. 3, hydrogen and hydrocarbon feedstock are fed via line 110 to dewaxing reactor 114. The dewaxed product from dewaxing reactor 114 is fed via line 120, heat exchanger 122 and line 121 to oligomerization reactor 123. The product from the oligomerization reactor 123 is fed via line 125 to the hyrotreating and recovery section 130. This hydrotreating and recovery section 130 may comprise the same or different pieces and configuration of equipment shown in FIGS. 1 and 2 for performing these functions. Dewaxed product is withdrawn from the hydrotreating and recovery section 130 via line 132. A gasoline fraction is withdrawn from the hydrotreating and recovery section via line 134.

Hydrogen from the hydrotreating and recovery section 130 is recycled to the dewaxing reactor 114 via lines 140 and 110. Olefins, e.g. olefinic gasoline, from the hydrotreating and recovery section 130 are optionally recycled to the oligomerization reactor 123 via lines 142 and 121 or to the dewaxing reactor via lines 142, 144, 140 and 110. Optionally, a feed containing additional olefins, such as liquid petroleum gas from an FCC reactor (i.e. FCC LPG), may be fed to the oligomerization reactor 123 via lines 146 and 121.

What is claimed is:

1. A process for dewaxing a hydrocarbon feedstock comprising the steps of:

(a) catalytically dewaxing said feedstock by contact with a dewaxing catalyst under conditions sufficient to crack wax molecules and produce olefins having 10 or less carbon atoms; and (b) catalytically oligomerizing olefins in the effluent from step (a) by contact of the entire effluent from step (a) with an oligomerization catalyst under conditions sufficient to oligomerize olefins therein, wherein the temperature of the oligomerization reaction of step (b) is at least 5° C. less than the temperature of the dewaxing reaction of step (a), wherein the pour point of the effluent of step (a) is the same as the pour point of the effluent of step (b).

2. A process according to claim 1, wherein significant dewaxing does not occur in step (b).

3. A process according to claim 1, wherein the dewaxing catalyst and the oligomerization catalyst are the same catalyst.

4. A process according to claim 1, wherein step (a) and step (b) are conducted in different reactors, and wherein the effluent from step (a) is passed through a heat exchanger to reduce the temperature of the effluent prior to step (b).

5. A process according to claim 1, wherein the effluent from step (a) is mixed with additional olefins having 10 or less carbon atoms, and wherein this mixture is fed to step (b).

6. A process according to claim 1, wherein the dewaxing catalyst comprises an intermediate pore size zeolite.

7. A process according to claim 6, wherein the intermediate pore size zeolite comprises ZSM-5.

8. A process according to claim 7, wherein said zeolite contains nickel.

9. A process according to claim 1, wherein the hydrocarbon feed comprises a lubricant boiling range feed.

10. A process according to claim 1, wherein the hydrocarbon feed comprises a distillate feed.

11. A process according to claim 10, wherein the hydrocarbon feed comprises an atmospheric gas oil or a vacuum gas oil.

12. A process according to claim 1, wherein the dewaxing conditions in step (a) comprise hydrogen dosage rates between 0 and about 8000 SCF/BBL of feedstock, pressures between 790 and 2,790 kPa and temperatures between about 246° and 357° C.

13. A process according to claim 1, wherein the dewaxing conditions in step (a) comprise hydrogen dosage rates between 0 and about 8000 SCF/BBL of feedstock, pressures between 790 and 2,790 kPa and temperatures between about 260° and 454° C.

14. A process according to claim 1, wherein the effluent from step (b) is hydrotreated.

15. A process according to claim 14, wherein step (a), step (b) and hydrotreating each take place in separate reactors.

16. A process according to claim 1, wherein the entire effluent of step (a) is contacted with said oligomerization catalyst in accordance with step (b).

17. A process for dewaxing a hydrocarbon feedstock comprising the steps of:

(a) catalytically dewaxing said feedstock by contact with a dewaxing catalyst under conditions sufficient to crack wax molecules and produce olefins having 10 or less carbon atoms; and (b) catalytically oligomerizing olefins in the effluent from step (a) by contact of a side stream from the entire effluent from step (a) with an oligomerization catalyst under conditions sufficient to oligomerize olefins therein, wherein the temperature of the oligomerization reaction of step (b) is at least 5° C. less than the temperature of the dewaxing reaction of step (a), said side stream not having hydrocarbons removed therefrom by a hydrocarbon separation step, whereby said side stream has essentially the same olefin concentration as the entire effluent from step (a).

18. A process for dewaxing a hydrocarbon feedstock comprising the steps of:

(a) catalytically dewaxing said feedstock by contact with a dewaxing catalyst under conditions sufficient to crack wax molecules and produce olefins having 10 or less carbon atoms; and (b) catalytically oligomerizing olefins in the effluent from step (a) by contact of the entire effluent from step (a) with an oligomerization catalyst under conditions sufficient to oligomerize olefins therein, wherein the temperature of the oligomerization reaction of step (b) is at least 5° C. less than the temperature of the dewaxing reaction of step (a), wherein step (a) and step (b) take place in the same reactor and step (b) takes place in the final stage of said reactor.

19. A process for dewaxing a hydrocarbon feedstock comprising the steps of:

(a) catalytically dewaxing said feedstock by contact with a dewaxing catalyst under conditions sufficient to crack wax molecules and produce olefins having 10 or less carbon atoms; and (b) catalytically oligomerizing olefins in the effluent from step (a) by contact of the entire effluent from step (a) with an oligomerization catalyst under conditions sufficient to oligomerize olefins therein, wherein the temperature of the oligomerization reaction of step (b) is at least 5° C. less than the temperature of the dewaxing reaction of step (a), wherein the effluent from step (b) is hydrotreated, and wherein both step (b) and hydrotreating take place in a single multiple-stage reactor, and wherein step (b) takes place in the initial stage of this reactor.

20. A process for dewaxing a hydrocarbon feedstock comprising the steps of:

(a) catalytically dewaxing said feedstock by contact with a dewaxing catalyst under conditions sufficient to crack wax molecules and produce olefins having 10 or less carbon atoms; and (b) catalytically oligomerizing olefins in the effluent from step (a) by contact of the entire effluent from step (a) with an oligomerization catalyst under conditions sufficient to oligomerize olefins therein, wherein the temperature of the oligomerization reaction of step (b) is at least 5° C. less than the temperature of the dewaxing reaction of step (a), wherein step (b) comprises converting olefins by an alkylation reaction, whereby olefins alkylate aromatics and/or paraffins.

* * * * *